United States Patent [19]

Maffet

[11] 4,237,618

[45] Dec. 9, 1980

[54] PROCESS FOR MECHANICALLY DEWATERING SEWAGE SLUDGE

[75] Inventor: Vere Maffet, West Chester, Pa.

[73] Assignee: UOP Inc., Des Plaines, Ill.

[21] Appl. No.: 22,910

[22] Filed: Mar. 22, 1979

Related U.S. Application Data

[63] Continuation-in-part of Ser. No. 891,437, Mar. 29, 1978, Pat. No. 4,160,732, and Ser. No. 909,587, May 25, 1978, Pat. No. 4,193,206, which is a continuation-in-part of Ser. No. 775,673, Mar. 8, 1977, Pat. No. 4,128,946, Ser. No. 813,577, Jul. 7, 1977, Pat. No. 4,140,452, Ser. No. 813,578, Jul. 7, 1977, Pat. No. 4,098,006, Ser. No. 844,097, Oct. 20, 1977, Pat. No. 4,121,349, Ser. No. 858,879, Dec. 8, 1977, Pat. No. 4,161,825, and Ser. No. 891,437, Mar. 29, 1978, Pat. No. 4,160,732, which is a continuation-in-part of said Ser. No. 813,577, said Ser. No. 858,879, is a continuation-in-part of said Ser. No. 813,577 and said Ser. No. 813,578, said Ser. No. 844,097, is a continuation-in-part of said Ser. No. 813,578, said Ser. No. 813,577, and said Ser. No. 813,578, is a continuation-in-part of said Ser. No. 775,673.

[51] Int. Cl.[3] ..... F26B 7/00

[52] U.S. Cl. ..... 34/12; 100/117; 100/145; 210/760; 210/790

[58] Field of Search ..... 210/73 R, 74, 75, 402; 100/117, 145–150; 34/12

[56] References Cited

U.S. PATENT DOCUMENTS

| | | | |
|---|---|---|---|
| 1,772,262 | 8/1930 | Naugle | 110/11 |
| 3,695,173 | 10/1972 | Cox | 100/74 |
| 3,875,319 | 4/1975 | Seckler et al. | 210/74 |
| 3,938,434 | 2/1976 | Cox | 100/117 |
| 4,041,854 | 8/1977 | Cox | 100/112 |
| 4,070,175 | 1/1978 | Swanson et al. | 210/74 |
| 4,160,732 | 7/1979 | Maffet | 210/75 |

*Primary Examiner*—John J. Camby

*Attorney, Agent, or Firm*—James R. Hoatson, Jr.; John F. Spears, Jr.; William H. Page, II

[57] ABSTRACT

A process for mechanically dewatering fibrous organic wastes such as sewage sludge. The undewatered waste is passed into the first end of a cylindrical dewatering zone having a porous outer wall. A helical blade rotated within the dewatering zone pressurizes the waste and moves it to the outlet at the second end of the dewatering zone. A filter media comprising a cylindrical substantially unagitated layer of fibrous material derived from the waste is retained within an annular space located between the outer edge of the helical blade and the inner surface of the porous wall. Two or more dewatering zones and mixing zones are used in series to achieve the desired degree of dryness.

4 Claims, 3 Drawing Figures

PROCESS FOR MECHANICALLY DEWATERING SEWAGE SLUDGE

CROSS-REFERENCE TO RELATED APPLICATIONS

This application is a continuation-in-part of my prior copending applications Ser. No. 891,437 filed Mar. 29, 1978, now U.S. Pat. No. 4,160,732, and Ser. No. 909,587 filed May 25, 1978, now U.S. Pat. No. 4,193,206. Application Ser. No. 909,587 was filed as a continuation-in-part of my prior copending applications Ser. No. 775,673 filed Mar. 8, 1977 and issued as U.S. Pat. No. 4,128,946 on Dec. 12, 1978; Ser. No. 813,577 filed July 7, 1977, now U.S. Pat. No. 4,140,452; Ser. No. 813,578 filed July 7, 1977 and issued as U.S. Pat. No. 4,098,006 on July 4, 1978; Ser. No. 844,097 filed Oct. 20, 1977 and issued as U.S. Pat. No. 4,121,349 on Oct. 4, 1978; Ser. No. 858,879 filed Dec. 8, 1977, now U.S. Pat. No. 4,161,825, and Ser. No. 891,437 filed Mar. 29, 1978 and issued as U.S. Pat. No. 4,160,732 on July 10, 1979.

Application Ser. No. 891,437 is a continuation-in-part of application Ser. No. 813,577, which issued as U.S. Pat. No. 4,140,452.

Application Ser. No. 858,879 is a continuation-in-part of applications Ser. No. 813,577 and Ser. No. 813,578, which issued as U.S. Pat. No. 4,099,336.

Application Ser. No. 844,097, which issued as U.S. Pat. No. 4,121,349, is a continuation-in-part of application Ser. No. 813,578.

Applications Ser. No. 813,577 and 813,578 are continuations-in-part of application Ser. No. 775,673 which issued as U.S. Pat. No. 4,128,946.

The entire disclosure and teaching of each of these above-cited copending applications and issued patents is incorporated herein by reference.

FIELD OF THE INVENTION

The invention relates to a process for dewatering fibrous organic waste such as sewage sludge or wood pulp scraps. The invention more specifically relates to a process for mechanically dewatering sewage sludge wherein the undewatered feed stream in passed into a first cylindrical mechanical dewatering zone having a porous cylindrical sidewall and therein pressurized by a rotating helical blade. The invention is directly concerned with a dewatering process using a press wherein the liquid removed from the feed stream drains through a pressure surface comprising a layer of fibers collected from the feed stream. The invention is specifically directed to a process wherein a plurality of cylindrical mechanical dewatering zones are used in sequence, with the effluent of the first zone being charged to a second zone wherein additional dewatering is performed.

PRIOR ART

It has long been recognized that it would be advantageous to mechanically remove water from various waste and by-product sludges such as sewage sludge. In the specific case of sewage sludge, mechanical dewatering would reduce the amount of material to be disposed or transported, or the amount of water to be evaporated during various drying steps. Many different types of dewatering apparatus have been developed, but none is believed to have gained widespread usage and acceptance. Both the difficulties encountered in mechanically dewatering sewage sludge and a process for compacting the dried sludge into fertilizer pellets are described in U.S. Pat. No. 2,977,214 (Cl. 71-64).

One specific type of mechanical dewatering apparatus is a continuous filter belt which is slowly pulled through solids collection and removal areas. The device presented in U.S. Pat. No. 2,097,529 (Cl. 210-396) is of this type and may be used to dewater sewage sludge. Other sludge dewatering machines utilizing a moving filter belt are shown in U.S. Pat. Nos. 4,008,158 (Cl. 210-386) and 4,019,431 (Cl. 100-37). A belt or conveyor type sewage sludge dewatering device is also shown in U.S. Pat. No. 3,984,329 (Cl. 210-396). This reference is pertinent for its teaching of the benefits obtained by breaking up the layer of solid matter which forms on the perforate conveyor belt. These benefits include aiding the water in reaching the belt and a tendency to prevent the plugging of the openings in the belt.

U.S. Pat. Nos. 3,695,173 (Cl. 100-74); 3,938,434 (Cl. 100-117) and 4,041,854 (Cl. 100-112), all to C. H. Cox, are pertinent for their presentation of apparatus for dewatering sewage sludge in which a helical screw conveyor is rotated within a cylindrical and frusto-conical dewatering chamber having perforate walls. These references all describe apparatus in which the outer edge of the screw conveyor scrapes the inner surface of perforate wall. The inventions presented include specific coilspring wiping blades, slot-cleaning blades or brushes attached to the outer edge of the helical blade for continuous contact with the inside surface of the perforate wall, thereby cleaning solids therefrom. The two latest patents in this group are also relevant for their teaching of an alternative embodiment in which the terminal cylindrical portion of the screw conveyor blade does not follow closely the inner surface of the perforate wall but instead has a diameter approximately one-half the diameter of the dewatered solids output opening.

The subject process is distinguishable from these references by several points including the definite annular space provided between the outer edge of the screw conveyor blade and the inner surface of the perforate outer wall. This space begins at the first end of the screw conveyor, where the feed first contacts the conveyor, and continues for the entire length of the porous wall to the outlet of the apparatus. Smaller spacing between the parallel windings of the perforated outer wall also distinguishes the inventive concept.

Other references which utilize a rotating conveyor or auger within a perforated outer barrel are U.S. Pat. Nos. 1,772,262 issued to J. J. Naugle; 3,997,441 to L. F. Pamplin, Jr.; and 1,151,186 to J. Johnson. These references illustrate the use of a precoat layer located in a space between the conveyor and the inner surface of the barrel as an aid to filtration. The Naugle patent discloses that the precoat layer or filter media may be formed from solids present in a liquid to be filtered. However, these references, and particularly the Naugle patent, are directed to the filtration of such materials as sugar juices, suspensions of clays, chalks, and the like rather than fibrous organic waste processed in the subject invention. These references also do not teach the specific mechanical limitations and arrangements employed herein to successfully dewater these materials.

BRIEF SUMMARY OF THE INVENTION

The invention provides a simple, economical and efficient process for mechanically dewatering organic waste which is capable of producing sewage sludge effluent streams containing over 60 wt.% solids. One embodiment of the invention may be broadly characterized as a dewatering process which comprises the steps of passing a feed stream comprising organic waste and which comprising at least 50 wt.% water and more than 5 wt.% fibers into the first end of a first dewatering zone comprising a uniformly cylindrical chamber having a cylindrical porous wall formed by parallel windings spaced about 0.0075 to about 0.013 cm. apart; pressurizing the feed stream to a superatmospheric pressure by rotating a centrally mounted screw conveyor which extends between the first end and a second end of the first dewatering zone while constricting the opening at the second end of the first dewatering zone, with the blade of the screw conveyor having a uniformly helical outer edge which is separated from the inner surface of the porous wall by a distance of from about 0.08 to 5.0 cm.; maintaining a substantially continuous and unagitated cylindrical layer of filter media comprising fibers derived from the feed stream in an annular space located between the inner surface of the porous wall and the outer edge of the screw conveyor while simultaneously transferring organic waste through the center of the first dewatering zone from the first end to the second end of the first dewatering zone; withdrawing water radially from the first dewatering zone through the porous wall and the cylindrical layer of filter media; withdrawing a first dewatering zone solids stream having a higher organic waste solids content than the feed stream from the second end of the first dewatering zone; depressurizing the first dewatering zone solids stream; passing the first dewatering zone solids stream into the first end of a second dewatering zone constructed and operated substantially the same as the first dewatering zone; withdrawing additional water radially from the second dewatering zone, and thereby forming a second dewatering zone solids stream comprising over 50 wt%. solids.

DESCRIPTION OF THE DRAWING

Referring now to FIG. 1, raw sewage sludge or other organic waste to be dewatered enters the apparatus through an inlet throat 1 and is directed downward to the first end of a dewatering zone where it makes contact with a screw conveyor having a helical blade 4. The shaft 2 of the screw conveyor extends out of the cylindrical chamber surrounding the dewatering zone through a seal and bearing 5 and is connected to a drive means not shown which rotates the screw conveyor. The rotation of the screw conveyor pressurizes the organic waste by pushing it toward the second end of the dewatering zone and against the cylindrical porous wall 3 which encircles the screw conveyor. The outer end of the conveyor is supported by a bearing 7 at the center of a spider or cross-member 6. The spider is in turn held in place by a threaded cap 8 having an opening 12 at the second end of the dewatering zone. The outer end of the arms of the spider are retained between a raised lip 13 on the inner surface of the chamber and the cap.

Fibrous material from the entering feed stream accumulates in an annular space between the outer edge of the screw conveyor and the inner surface of the porous wall. Water is expressed radially through this built-up layer of fiber and through the porous wall. The water is directed into a basin 10 by a shroud 9 which surrounds the upper portions of the porous wall and is then drawn off through line 11.

Figure 1:
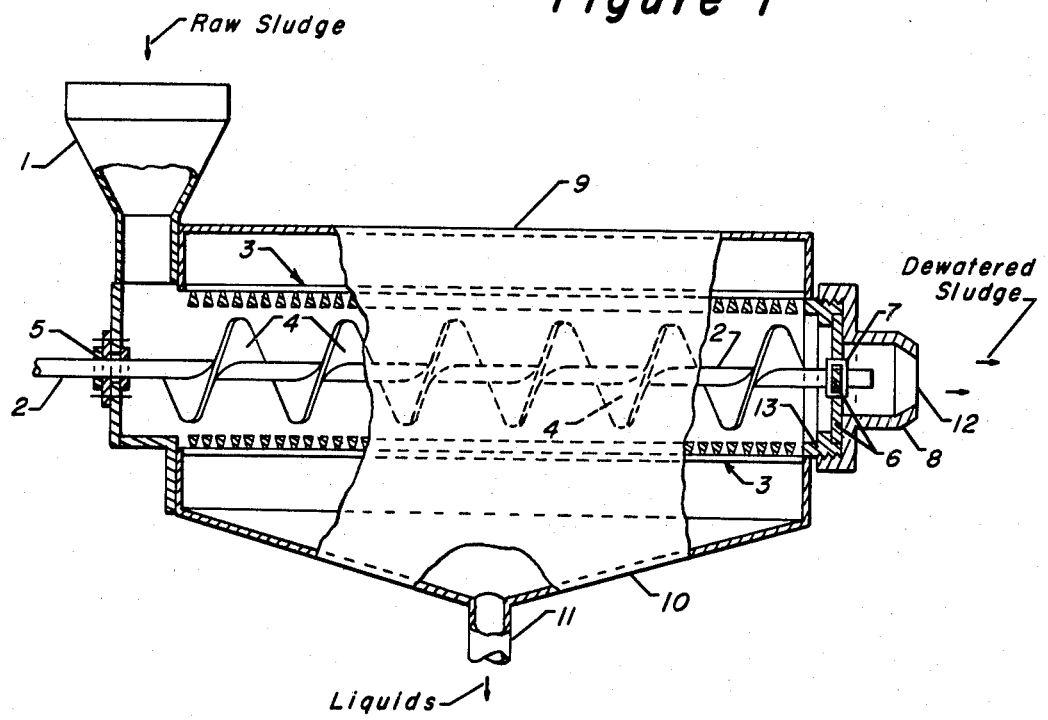
FIG. 1 is a cross-sectional view along a vertical plane of an apparatus which may be used to perform the subject process.
Figure 2:
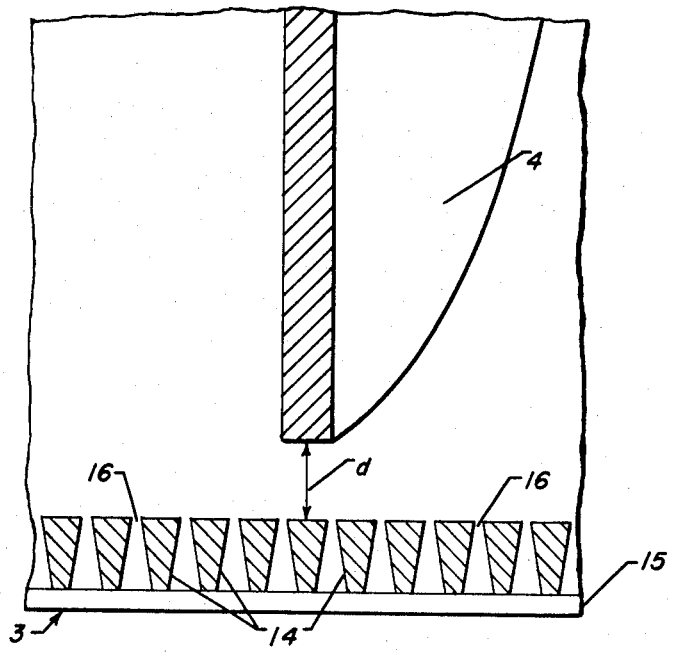
FIG. 2 is an enlarged cross-sectional view of a small portion of the screw conveyor blade and porous wall shown in FIG. 1.

The preferred construction of the cylindrical porous wall 3 is shown in detail in FIG. 2. The wall is formed by parallel spiral windings of tapered wire 14 which are welded to several connecting rods 15 at the smaller outer edge of each winding. The connecting rods are in alignment with the central axis of the cylinder formed by the wall. The broader edge of each winding faces inward towards the blade 4 of the screw conveyor, with each winding being separated by a uniform space 16 through which water may pass. The inner surface of the porous wall is separated from the outer edge of the helical blade by preferably constant distance "d.38

Figure 3:
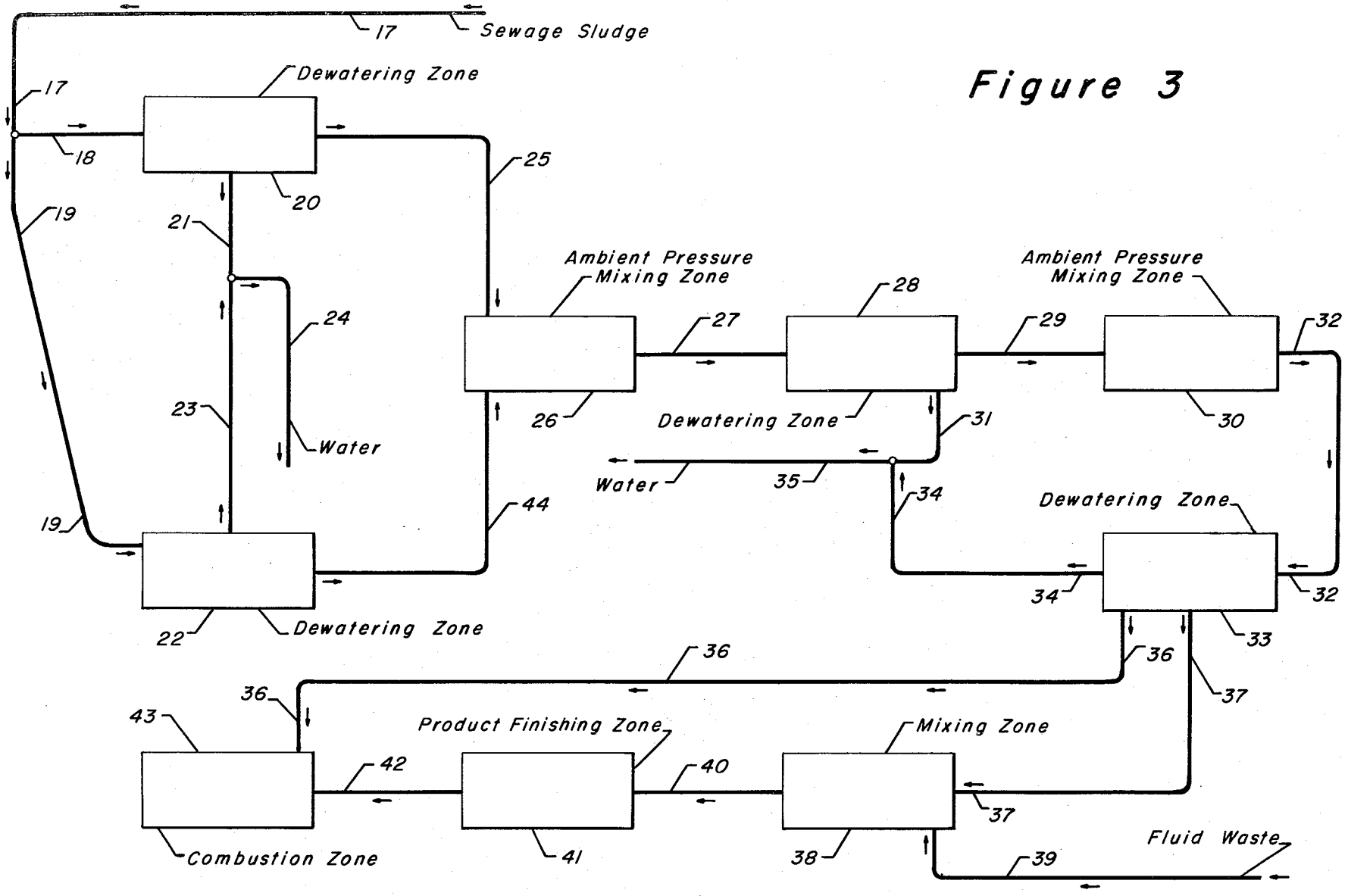
FIG. 3 is a schematic diagram of a process in which four mechanical dewatering zones are utilized to convert sewage sludge into a fuel suitable for use in a combustion zone used to generate heat or steam.

Referring now to FIG. 3, a stream of raw sewage sludge enters the process through line 17 and is distributed to a first dewatering zone 20 and a second dewatering zone 22 through conveyance means 18 and 19 which may be belt-type conveyors or screw-type conveyors. Water is removed from the sludge in each zone and exits the zones in lines 21 and 23 for disposal through line 24. The dewatering zone solids streams in lines 25 and 44 have approximately the same solids content. These two solids streams are admixed at ambient pressure in a mixing zone 26 and then passed into a third mechanical dewatering zone 28 through line 27. The material flowing through line 29 preferably contains at least 50 wt.% solids.

The dewatering zone solids stream flowing through line 29 is passed into another ambient pressure mixing or homogenizing zone 30. The effluent stream of this mixing zone is then charged to a fourth mechanical dewatering zone 33 through line 32. Water from the third dewatering zone in line 31 and water from the fourth dewatering zone in line 34 is admixed and passed to a disposal facilities through line 35. In one embodiment of the invention, the solids effluent stream of the fourth dewatering zone may be passed through line 36 directly into a combustion zone 43 wherein it is consumed as fuel. As an alternative, a portion or all of the solids effluent stream of the fourth dewatering zone is transferred through line 37 and blended with a small amount of a fluid hydrocarbonaceous or vegetable waste stream carried by line 39 in a mixing zone 38. The effluent of this mixing zone is passed through line 40 into a product finishing zone 41 wherein by extrusion the dewatered solids-fluid waste blend is transformed into uniform size fuel particles. These fuel particles are then carried to the combustion zone by conveyance means 42.

These drawings are presented to ensure a clear understanding of the inventive concept and are not intended to exclude from the scope of the invention those other embodiments set out herein or which are the result of normal and reasonable modification of those embodiments.

DETAILED DESCRIPTION

Large amounts of organic waste are generated daily from many sources. As used herein, the term "organic waste" is intended to include carbon-containing substances which are derived directly or indirectly from living or formerly living organisms. Specific examples include sewage sludge, fat, meat scraps, bone meal, leather scraps, hair, manure from animal sources, beet pulp, fruit pumice, vegetable and fruit peels and pieces, canning plant waste, eggs and egg shells, straw and animal bedding, bagasse, fermentation and distillation residues from vegetable sources, protein or sugar production plant effluents, kelp, wood chips, wood pulp, paper mill scraps and effluents and pharmaceutical wastes. The organic waste feed stream preferably comprises a sewage sludge produced in a municipal sewage treatment plant. It may be primary, secondary, or tertiary sludge which is digested or undigested. Preferably, the feed stream to the process contains about 15–25 wt.% or more solids and 5 wt.% fibers on a dry basis. That is, the organic waste feed stream will preferably contain about 15–25 wt.% solids before it is dewatered or fed to the process and should contain more than 5 wt.% fibers or fibrous material on a dry basis. The organic waste feed stream may, however, contain as little as 0.4 wt.% solids or as much as 60 wt.% solids in the specific case of sewage sludge. A typical undewatered sewage sludge will contain at least 50 wt.% water and a large amount of inorganic ash. Other components of sewage sludge include various soluble salts and minerals, water-soluble hydrocarbonaceous compounds, hydrocarbons, and cellulosic fibers, as from paper products and vegetable roughage. There is no apparent upper limit on acceptable fiber contents.

It is often desirable to remove some or most of the water present in an organic waste before it is consumed or disposed of. For instance, drying sewage sludge produces a solid material which may be formed into a very satisfactory fertilizer and soil builder. The dry form of the sludge is preferred since it is lighter for the same solids content, is less odoriferous, is easily stored in bags, and is easily applied using common types of dry fertilizer spreaders. It may be desirable to dewater other organic wastes to limit liquid run-off, to reduce disposal problems, to reduce the weight of wastes to be transported, to recover water for reuse, or to prepare the wastes for further processing. The inventive concept is therefore utilitarian in many different applications.

Water can normally be driven off organic wastes by the application of heat. However, this procedure normally requires the consumption of inceasingly expensive fuel and leads to its own problems, including flue gas and vapor stream discharges. It is therefore desirable to mechanically dewater organic waste to the maximum extent possible and feasible and utilize thermal drying only as a final drying or sterilization step.

Despite the incentive provided by the benefits to be obtained by mechanical dewatering, the various continuous belt filtration devices have apparently not evolved to the point where they produce dewatered sewage sludges containing more than about 25–30 wt.% solids. This limitation also seems to apply to the extrusion press apparatus described in the previously referred to Cox U.S. Pat. No. 3,695,173 since it is specified as having produced sludge filtrates containing 66 and 71 percent moisture. It therefore appears that the prior art has not provided a method of mechanically dewatering sewage sludge which produces an effluent stream approaching or exceeding a 40 wt.% solids content.

It is an objective of this invention to provide a process for mechanically dewatering organic waste. It is another objective of this invention to provide a simple and effective process for the dewatering of sewage sludge. Another objective of the invention is to provide a process to mechanically dewater sewage sludge to a solids content greater than 60 wt.%, and preferably in excess of 75 wt.%. A further objective of the subject invention is to provide a method of drying sewage sludge and converting the sludge to a fire-sustaining fuel.

The process of the present invention is carried out using a number of dewatering zones. Each of these dewatering zones preferably comprises a porous cylindrical chamber having a first end which is sealed except for an organic waste inlet conduit and an opening for a rotating drive shaft and a second end having an opening for the discharge of the dewatered organic waste. The terminal portions of the chamber located adjacent to the central porous section of the chamber are preferably imperforate to provide greater structural strength. The chamber should have a length to inside diameter ratio above 2:1 and preferably from about 4:1 to about 20:1. The inside diameter of this chamber is preferably uniform along the length of the chamber. The cylindrical chamber of the subject dewatering zone corresponds to the barrel of a typical extruder. A major portion of the distance between the ends of the chamber is devoted to providing a porous outer wall through which water is expressed. This porous wall is to be cylindrical and preferably has the same inside diameter as the rest of the chamber, with the exception that a raised lip may be present at the second end of the chamber to aid in positioning equipment located at the end of the chamber.

The porous wall is preferably fashioned from a continuous length of wedge-shaped bar which is welded to several connecting members running along the length of the porous wall as shown in the drawing. This construction provides a continuous spiral opening having a self-cleaning shape. That is, the smallest opening between two adjacent parallel windings is at the inner surface of the porous wall, thereby providing a continuously widening space which allows any particle passing through the opening to continue outward. The outward movement of these particles is aided by the radially flowing water. Wedge-shaped wound screens of the desired shape are available commercially and are used as well screens and to confine particulate material within hydrocarbon conversion reactors. Other types of porous wall construction meeting the criteria set out herein may also be used.

The distance between adjacent windings, or the equivalent structure of other screen materials, used in the porous wall should be within the range of from about 0.0075 to about 0.013 cm. (or about 0.003 to 0.005 inches). This distance is smaller than that specified in the previously referred to Cox U.S. patents, which is 0.006 inches in U.S. Pat. No. 3,695,173 and 0.008 inches in U.S. Pat. No. 3,938,434. The subject process is therefore performed in an apparatus having a considerably smaller opening than called for by the prior art.

A screw conveyor having a helical blade is centrally mounted within the cylindrical chamber. The major central axis of this conveyor is preferably coextensive with the major axis of the cylindrical chamber and the porous cylindrical wall. The chamber and porous wall are therefore concentric about the screw conveyor. It is critical to the proper performance of the process that the outer edge of the blade of the screw conveyor be spaced apart from the inner surface of the porous wall by a distance greater than about 0.08 cm. but less than about 5.0 cm. Preferably, the outer edge of the screw conveyor is at least 0.2 cm. but less than 2.0 cm. from the inner surface of the porous wall. It is especially preferred that a minimum distance of 0.44 cm. is provided between the outer edge of the screw conveyor and the porous wall. This distance should be substantially uniform along the distance the two elements are in juxtaposition.

The purpose of this separation between the screw conveyor and the wall is to provide a relatively unagitated layer of fibrous filter media on the inner surface of the porous wall. This filter media has an annular shape conforming to the inner surface of the porous wall and the cylinder swept by the outer edge of the screw conveyor. The term "unagitated" is intended to indicate that this filter bed is not mixed or sliced by any mechanical element extending toward the porous wall from the blade. This arrangement is contrasted to the previously referred to extrusion press apparatus in which the surface of the porous wall is "scraped" by the screw conveyor and blades or brushes are attached to the blade to clean the openings in the porous wall.

Although it is free of mechanical agitation, the annular layer of filter media covering the inner surface of the dewatering zone will not be stagnant and undisturbed since it will be subjected to the stress and abrasion which result from the rotation of the screw conveyor. The associated shear stress will extend radially outward through the filter bed to the porous wall, thereby by exerting a torque on the entire bed and causing some admixture of the filter media. This torque may actually cause the annular layer of filter media to rotate with the screw conveyor. The speed of rotation and linear velocity of the filter bed toward the second end of the cylindrical chamber will probably at all times be less than that of organic waste solids located in the grooves of the screw conveyor. It is theorized that the filter media may be self-cleaning because of the continuous movement occurring along both of its surfaces. This action may explain the superior performance of the subject invention as compared to conventional processes in which the interface between a filter belt and accumulated material is essentially static.

The subject process is operated in a manner contrary to the teaching of the prior art in several areas. For instance, the prior art describes the problem of the porous wall or filter belt becoming clogged and teaches that the built-up layer of solids should be agitated or scraped from the porous wall. The subject process utilizes a wall having smaller openings which would seem to be more easily clogged. It also requires an unagitated layer of built-up fibers to cover the entire porous wall.

The necessary space between the edge of the screw conveyor and the inner surface of the porous wall may also be characterized by the ratio of the outer diameter of the screw conveyor to the inner diameter of the porous wall. This ratio should be between about 0.95:1 to about 0.8:1 when the inner diameter of the porous wall is between 5 cm. and 25 cm. The distances specifically set out above must be maintained at all times and are to govern in any case of conflict between these two methods of characterizing the invention.

The screw conveyor is rotated to move the organic waste to the outlet of the dewatering zone, pressurizing the material within the dewatering zone and thereby causing water to flow radially through the layer of filter media and the porous wall. The screw conveyor may be rotated at from about 10 to about 150 rpm, or even more rapidly if desired. However, it is preferred to operate the dewatering zone with the screw conveyor rotating at from 20 to 60 rpm. Only a moderate superatmospheric pressure is required within the dewatering zone. A pressure of less than 500 psig. is sufficient, with the pressure preferably being less than 100 psig. The process may be operated at ambient temperatures, with temperatures below 32° C. being preferred when most organic wastes including raw sewage sludge are to be dewatered. It is therefore not normally necessary to provide either heating or cooling elements along the length of the dewatering zone. However, it has recently been discovered that heat should be applied during the dewatering of a secondary sludge. The heat may be applied by a heater having a surface above 149° C. which is in contact with the upper surface of the porous wall and should heat the sludge to an average temperature above 60° C.

The screw conveyor should have a length to diameter ratio above 2:1 and preferably in the range of from 4:1 to about 20:1. A unitary one-piece screw conveyor is preferred. The design of the screw conveyor is subject to much variation. The pitch or helix angle of the blade need not change along the length of the screw conveyor. However, constant pitch is not critical to successful performance of the process, and the pitch may be varied if so desired. Another common variable is the compression ratio of the screw conveyor or auger. The compression ratio refers to the change in the flight depth along the length of the screw conveyor, with the flight depth being measured from the surface of the shaft of the screw conveyor to the outer edge of the helical blade. As used herein, a 10:1 compression ratio is intended to specify that the flight depth at the terminal portion of the screw conveyor is one-tenth as great as the flight depth at the initial or feed receiving portion of the screw conveyor. The compression ratio of the screw conveyor is preferably below 15:1 and more preferably is in the range of from 1:1 to 10:1. Suitable screw conveyors, drive components and reduction gears are readily available from firms supplying these items for use in the extrusion of plastics, etc.

The preferred embodiment of the invention may be characterized as a process for dewatering fibrous organic waste which comprises the steps of passing a feed stream comprising organic waste and which comprises 50 wt.% water and at least 5 wt.% fibers on a dry basis into a first end of a dewatering zone comprising a cylindrical chamber having a cylindrical porous wall formed by parallel windings which are spaced apart by a distance of about 0.0075 to about 0.013 cm.; pressurizing the feed stream within the dewatering zone to a pressure less than 100 psig. but greater than that present at the outer surface of the cylindrical porous wall by rotating a screw conveyor having a helical blade which begins at the first end of the dewatering zone and which is centrally mounted within the cylindrical chamber while constricting the opening available at a second end of the dewatering zone to less than the available cross-sectional area of the cylindrical chamber, the blade of the screw conveyor having a helical outer edge which is separated from the inner surface of the porous wall by a distance of from about 0.2 to 2.0 cm. along the length of the porous wall, and with the screw conveyor having a length to diameter ratio above 4:1; maintaining a substantially continuous and unagitated cylindrical layer of filter media comprising fibers derived from the feed stream in an annular space located between the inner surface of the porous wall of the cylindrical chamber and the helical outer edge of the screw conveyor, and simultaneously transferring the organic waste located between the grooves of the helical blade of the screw conveyor and surrounded by said cylindrical layer of filter media from the first end of the dewatering zone to the second end of the dewatering zone; withdrawing water radially from the dewatering zone through the porous wall and through said cylindrical layer of filter media; withdrawing a first dewatering zone solids stream having a higher organic waste solids content than the feed stream from the second end of the dewatering zone; depressurizing the first dewatering zone solids stream to substantially ambient atmospheric pressure; passing the first dewatering zone solids stream into the first end of a second dewatering zone operated at conditions substantially the same as the first dewatering zone and constructed in substantially the same manner as the first dewatering zone, and extracting additional water from the first dewatering zone solids stream to produce a second dewatering zone solids stream comprising over 50 wt.% solids; depressurizing the second dewatering zone solids stream to substantially ambient atmospheric pressure; passing the second dewatering zone solids stream into the first end of a third mechanical dewatering zone operated at conditions substantially the same as the first dewatering zone and constructed in substantially the same manner as the first dewatering zone, and extracting additional water from the second dewatering zone solids stream to thereby form a third dewatering zone solids stream comprising over 60 wt.% solids. As used herein, a description of a second dewatering zone as being constructed or operated in substantially the same manner as a prior zone is intended to incorporate all limitations and description which have been used to characterize the prior zone.

Single stage dewatering zones such as those used in the subject process have been operated continuously for several hours with no detectable clogging of the porous cylindrical wall or degradation in overall performance. They are capable of achieving an extremely high water rejection. The subject process therefore appears to be an improvement over the prior art and fulfills the objectives set for the invention.

The subject process is in fact so effective at dewatering sewage sludge that it may be carried to virtually any practically desirable degree of dryness. As described in my prior application Ser. No. 813,577, the consistency of the sewage sludge changes from a free flowing mud at 20 wt.% solids to a crumbly rubbery mass at about 40–45 wt.% solids. To date this change in consistency and flow characteristics has limited the maximum solids content of the output of a single stage dewatering unit to about 40–45 wt.%. The limitation is believed to be the result of the inability of the screw conveyor to generate a high pressure in the feed or inlet portion of the dewatering zone because of the soupy consistency of the feed sewage sludge. In my prior application this problem is overcome by admixing dry solids into the feed sludge and thickening it.

By performing two or more separate dewatering zone passes the previously required solids recycle can be eliminated and very high solids content can be achieved. For instance, sewage sludge was mechanically dewatered to a solids content of approximately 94 wt.% in three passes through a dewatering zone containing a one-inch O.D. screw conveyor. The initial step in this three-pass process was to collect a quantity of partially dewatered solid from the dewatering zone and then to stop feeding the undewatered sewage sludge to the dewatering zone. The collected material was then run through the dewatering zone at the same operating conditions as the first pass and the still further dewatered solid was collected. The material collected from the second pass was then fed into the dewatering zone, which was still operated in the same manner as the first pass. The resultant dewatered sewage sludge was at least as dry as is required or desired for the final pelletizing operation in which it may be formed into fertilizer pellets.

This multi-pass dewatering process may be performed in a batch-type system utilizing a single dewatering zone. Preferably, it is performed using two or more separate dewatering zones in series as shown in FIG. 3. For instance, the solids stream of two first-stage dewatering zones of uniform size may be passed into a single third dewatering zone which is also of the same design and is operated at the same conditions as the first two dewatering zones. Preferably, these two first-stage dewatering zones produce dewatering zone solids streams having substantially the same solids content. The dewatering zone solid streams are physically discharged from their cylindrical dewatering zones before their admixture, which preferably is performed at or near ambient atmospheric pressure. A slight positive or negative pressure may be maintained in the mixing zones as part of an odor or pollution control system.

The operation of each individual dewatering zone may be adjusted to regulate the solids content of the solids stream by varying the pressure imposed within the dewatering zone. This adjustment is performed by changing the total available cross-sectional area of the opening or openings at the outlet of the dewatering zone. The cross-sectional area may be automatically varied based on several measurable parameters such as the determined solids content of the solids stream, the pressure within the dewatering zone, or the torque on the shaft of the screw conveyor. A preferred control method for the process comprises metering the rate at which undewatered solid waste is charged into the dewatering zone and the rate at which water is rejected from the dewatering zone and passing signals representative of these two flow rates to an automatic controller. This controller is programmed with the solids content of the undewatered sewage sludge, which with proper care should not fluctuate over short time periods, and with the desired water rejection rate. By comparison of the measured water rejection rate to the desired rate, a suitable control signal may be generated. This signal is then transmitted to an adjusting means which varies the available cross-sectional area of the discharge opening at the second end of the dewatering zone. The restriction required at the discharge end of the dewatering zone may be quite minimal, and in some cases, no restriction may be required.

It is preferred that the solids effluent stream of each but the last dewatering zone is passed into a mixing zone. This zone may function to admix the solids streams of two or more dewatering zones or it may backmix and homogenize only a single solids stream. This mixing is desired to smooth variations in the solids content or the overall consistency of the solids stream charged to the next dewatering zone. The use of mixing zones thereby promotes uniform operation of the dewatering zones. The mixing zones preferably comprise rotating blades which mechanically agitate the solids streams and which are encased within substantially closed chambers. The mixing zones may be used as part or all of the cnveyancing means used to transport the solids streams to the next dewatering zone. Alternatively and preferably, the mixing zones are integrated into the first end of each dewatering zone. If two or more solids streams are passed into a single mixing zone, it is preferred that they have substantially the same solids contents. As used herein, the term "substantially the same solids content" and similar phrases is intended to indicate a difference in solids contents of less than 5.0 wt.%.

In a specific embodiment of the invention, sewage sludge is dried and converted into a fuel which is suitable for use in fired power plants used to produce steam, to heat housing or commercial structures, or to supply heat to chemical, industrial or petroleum processes. In this embodiment, the final product may be produced in a product finishing zone similar to those described in my prior applications. This zone is employed to convert the dried sludge into relatively uniform, small but dust-free particles which are highly suited to handling in mechanical furnace stoking systems. The teachings of my U.S. Pat. Nos. 4,098,006; 4,099,336; and 4,128,946 are particularly applicable to this finishing step. Preferably, the finishing step comprises the extrusion of the dried sludge through a die plate at a pressure and temperature which causes a partial plasticization of the dried sludge. A temperature in the range of 110° C. to about 170° C. and a pressure in the range of about 500 to 1000 psig. or more may be maintained in the extrusion zone. A plasticizer and/or an extrusion aid may be admixed into the dried sludge prior to its passage into the finishing zone.

Preferably, the additive which is admixed with the dried sludge prior to produce finishing is a low cost high BTU content fluid waste material. An example of this is used motor oil, and other contaminated petroleum-derived lubricants. A plant-derived oil or the heavy tarry by-products of alkylation and oligomerization processes may also be employed as the additive. As an alternative to the use of a waste material, the additive may be a high boiling (10% boiling point above 400° F.) petroleum fraction such as reduced crude, vacuum column bottoms (asphalt), vacuum column pitch, a shale oil-derived kerogen fraction or petroleum wax. The additive may also comprise coal particles suspended in a suitable solvent. These materials may act as a plasticizer or an extrusion aid as characterized in my prior applications. However, these materials are compounded into the dried waste primarily as a means to consume them in a useful manner while simultaneously increasing the BTU content of the final product.

The petroleum-derived additives may contain substantial sulfur concentrations. The sulfur content of these additives can exceed 0.3 wt.%, and may be as high as 1.0 wt.% sulfur. The burning of these materials in a combustion system which is not equipped with facilities to remove sulfur oxides from the resultant flue gas will probably be in violation of pollution control standards. By mixing the high sulfur petroleum fraction with the relatively low sulfur or sulfur-free dried sludge the sulfur is diluted sufficiently to allow the high sulfur fuel to be burned without desulfurization. This admixture has the additional benefit of lowering the overall ash content of the fuel from the high levels associated with sewage sludge. The quality of the fuel is therefore increased because of a higher BTU/lb rating and a lower ash content. It is preferred that the petroleum derived additive is compounded into the dried sludge at a rate of from about 1.0 to 10.0 lbs. of additive to 100 lbs. of dried sludge.

The use of a product finishing zone of any type is not mandatory to utilize the dried sludge as a fuel. The admixture of the fluid waste or any other additive into the dried sludge is also not required. The dried sludge may therefore be used as fuel in the same form as it emerges from the final dewatering zone. This corresponds to the passage of the dried sludge through line 36 of the Drawing directly from a final dewatering zone to the combustion zone. The solids stream removed from the final mechanical dewatering zone may be thermally dried if this is necessary to produce a product better adapted to bulk transfer and storage.

I claim as my invention:

1. A process for dewatering fibrous sewage sludge which comprises the steps of:

(a) passing a feed stream comprising sewage sludge which comprises 50 wt.% water and at least 5 wt.% fibers on a dry basis into a first end of a first dewatering zone comprising a cylindrical chamber having a cylindrical porous wall formed by parallel windings which are spaced apart by a distance of about 0.0075 to about 0.013 cm.;

(b) pressurizing the feed stream within the first dewatering zone to a superatmospheric pressure by rotating a screw conveyor having a helical blade which begins at the first end of the first dewatering zone and which is centrally mounted within the cylindrical chamber while constricting the opening available at a second end of the first dewatering zone to less than the available cross-sectional area of the cylindrical chamber, the blade of the screw conveyor having a helical outer edge which is separated from the inner surface of the porous wall by a distance of from about 0.08 to 5.0 cm. along the length of the porous wall, and with the screw conveyor having a length to diameter ratio above 2:1;

(c) maintaining a substantially continuous and unagitated cylindrical layer of filter media comprising fibers derived from the feed stream in an annular space located between the inner surface of the porous wall of the cylindrical chamber and the helical outer edge of the screw conveyor, and simultaneously transferring the organic waste located between the grooves of the helical blade of the screw conveyor and surrounded by said cylindrical layer of filter media from the first end of the first dewatering zone to the second end of the first dewatering zone;

(d) withdrawing water radially from the first dewatering zone through the porous wall and through said cylindrical layer of filter media;

(e) withdrawing a first dewatering zone solids stream having a higher organic waste solids content than the feed stream from the second end of the first dewatering zone;

(f) depressurizing the first dewatering zone solids stream to substantially ambient atmospheric pressure;

(g) passing the first dewatering zones solids stream into the first end of a second dewatering zone operated at conditions substantially the same as the first dewatering zone and constructed in substantially the same manner as the first dewatering zone, and extracting additional water from the first dewatering zone solids stream to produce a second dewatering zone solids stream comprising over 50 wt.% solids;

(h) depressurizing the second dewatering zone solids stream to substantially ambient atmospheric pressure; and, (i) passing the second dewatering zone solids stream into the first end of a third dewatering zone operated at conditions substantially the same as the first dewatering zone and constructed in substantially the same manner as the first dewatering zone, and extracting additional water from the second dewatering zone solids stream to thereby form a third dewatering zone solids stream comprising over 60 wt.% solids.

2. The process of claim 1 further characterized in that the outer edge of the screw conveyor is separated from the inner surface by a distance between 0.2 and 2.0 cm.

3. The process of claim 1 further characterized in that the first dewatering zones solids stream is first depressurized and is then passed into a first mixing zone wherein it is mechanically agitated and homogenized to a uniform consistency prior to passage into the second dewatering zone.

4. The process of claim 3 further characterized in that the first dewatering zone solids stream is admixed with a fourth dewatering zone solids stream within the first mixing zone and in that the fourth dewatering zone solids stream has a solids content substantially the same as the first dewatering zone solids stream.

* * * * *